US005595511A

United States Patent [19]

Okada

[11] Patent Number: 5,595,511

[45] Date of Patent: Jan. 21, 1997

[54] BATTERY TERMINAL

[75] Inventor: Hajime Okada, Yokkaichi, Japan

[73] Assignee: Sumitomo Wiring Systems, Ltd., Yokkaichi, Japan

[21] Appl. No.: 580,583

[22] Filed: Dec. 29, 1995

Related U.S. Application Data

[62] Division of Ser. No. 161,574, Dec. 6, 1993, Pat. No. 5,558,544.

[30] Foreign Application Priority Data

| | | | |
|---|---|---|---|
| Dec. 7, 1992 | [JP] | Japan | 4-84121 |
| Dec. 7, 1992 | [JP] | Japan | 4-84122 |
| Dec. 7, 1992 | [JP] | Japan | 4-84131 |

[51] Int. Cl.[6] ..... H01R 13/631

[52] U.S. Cl. ..... 439/762; 439/770

[58] Field of Search ..... 439/754–774

[56] References Cited

U.S. PATENT DOCUMENTS

| | | | |
|---|---|---|---|
| 1,746,514 | 2/1930 | Baunach | 439/762 |
| 3,116,100 | 12/1963 | Hunter | 439/762 |
| 3,568,139 | 2/1971 | Delzer | 439/759 |
| 4,747,793 | 5/1988 | Fukada et al. | 439/762 |
| 5,088,941 | 2/1992 | Nolle | 439/762 |
| 5,290,646 | 3/1994 | Asao et al. | 429/178 |
| 5,302,142 | 4/1994 | Tabata | 439/762 |
| 5,302,143 | 4/1994 | Inoue et al. | 439/762 |
| 5,454,741 | 10/1995 | Okada | 439/762 |

FOREIGN PATENT DOCUMENTS

| | | |
|---|---|---|
| 2100482 | 3/1972 | France . |
| 49736 | 3/1992 | Japan . |
| 439304 | 6/1992 | Japan . |
| 597056 | 12/1993 | Japan . |
| 1288001 | 9/1972 | United Kingdom . |

*Primary Examiner*—Hien D. Vu
*Attorney, Agent, or Firm*—Greenblum & Bernstein, P.L.C.

[57] ABSTRACT

A battery terminal for a terminal post of a battery includes a terminal body formed by a single plate. The terminal body has top and bottom terminal members each continuous to top and bottom tightening members. The top and bottom tightening members are provided with tapered outer surfaces. A tightening tool having upper stage tapered surfaces and lower stage tapered surfaces is place above the tightening members. When the tightening tool is pressed against the tightening members, the upper stage tapered surfaces and the lower stage tapered surfaces press said first and second tapered outer surface to compress said top and bottom terminal members to firmly hold the terminal post.

2 Claims, 9 Drawing Sheets

BATTERY TERMINAL

This application is a division, of application Ser. No. 08/161,574, filed Dec. 6, 1993, now U.S. Pat. No. 5,558,544.

BACKGROUND OF THE INVENTION

1. Field of the Invention

The present invention relates to a battery terminal mounted to the electrode (battery post) of a battery installed mainly in a motor vehicle and, more particularly, to a battery terminal in which the vertically-applied tightening force is converted to a horizontal force for securely clamping the battery terminal to the battery post. And this battery terminal is forcibly separated from the battery post by loosening the tightening bolt and is easily removed from the battery post.

2. Description of the Prior Art

With a conventional battery terminal for use mainly in a motor vehicle, an annular terminal fitting is fit over the battery post projecting from the battery, and the base part continuous to the free end of the terminal fitting is clamped using a bolt and nut tightened by an impact wrench or other tightening tool from the horizontal direction.

The engine compartments of recent vehicles, however, are crowded with a growing number of components installed in a confined space. This makes it difficult to adequately tighten the terminal fitting by applying a horizontal force because of interference by other engine compartment components with the tools. It is even possible for the impact wrench to contact the negative terminal while tightening the positive terminal fitting, causing an electrical short which, in a worst-case scenario, could cause an engine compartment fire.

In FIGS. 15A, 15B, 15C, and 15D, a conventional battery terminal which is proposed in Japanese Utility Model Publication No. H4-9736 published Mar. 11, 1993 to resolve these problems is shown. As best shown in FIG. 15B, the battery terminal P1 comprises a terminal 3 with a base 3*b* and a clamping member 3*c* positioned in mutual opposition and forming tapers widening toward the bottom, and providing a tightening member 5 bridging the base 3*b* and clamping member 3*c* with a similar tapered shape having the wide side to the bottom. A through-bolt 4 is tightened from above to tighten the base 3*b* and clamping member 3*c* by the tightening member 5, thus causing the terminal fitting 3*a* to securely hold at a post 2 of the battery 1, as shown in FIG. 15C.

However, when the battery terminal P1 is connected to the battery post 2, the spring in the base 3*b* and clamping member 3*c* deteriorates over time because the bolt 4 is tightened to deform and compress the base 3*b* and clamping member 3*c* by means of the tightening member 5. Thus, when replacing the battery 1, the base 3*b* and clamping member 3*c* do not return to the original position even when the bolt 4 is loosened, as shown in FIG. 15D. The terminal clamp 3*a* continuous to the base 3*b* and clamping member 3*c* does not spread open, and removal of the battery terminal P1 from the battery post 2 is difficult.

Furthermore with this conventional battery terminal P1, however the tightening force of the bolt spreads to the outside because both sides of the tightening member spread out to the bottom, the tightening member sides 5*a* and 5*b* cannot apply sufficient tightening force on the base 3*b* and clamping member 3*c* toward the inside, and as a result the terminal fitting 3*a* cannot be positively clamped to the battery post 2.

In FIGS. 16A and 16B, another battery terminal is shown which is disclosed in Japanese utility model application H4-38304 (not yet published) and assigned to the same assignee as the present application.

This battery terminal P2 comprises a terminal 3' with a cable connector 3*e*', terminal fitting member 3*a*', and base member 3*b*', curving and positioning in opposition one end of each of the top and bottom base members, which are approximately identical in shape. Pairs of right clamping members 3*c*'-1 and 3*c*'3 and left clamping members 3*c*'-2 and 3*c*'-4 are provided continuous to each free end of the pair of top and bottom annular terminal fitting members 3*a*', with 3*c*'-1 and 3*c*'-3 connected by curved member 3*c*'-5 and 3*c*'-2 and 3*c*'-4 connected by 3*c*'-6.

The tightening tool 5' that is the tightening member has an inverted U-shaped cross section on both sides of which is provided a notched member 5*e*' with tapered surfaces 5*a*', 5*b*', and 5*c*', 5*d*' in opposition on right and left sides and provided in two steps with the tapers widening toward the bottom.

A nut 6 is provided at the center of the base member 3*b*', which is formed by the top and bottom pair and right and left pairs of tightening members, of the terminal 3', i.e., between the top and bottom tightening members, and the outside surfaces of the clamping members 3*c*'-1 and 3*c*'-3 contact the tapered surfaces 5*a*', 5*b*' of the tightening tool 5', and the outside surfaces of the clamping members 3*c*'-2 and 3*c*'-4 contact the tapered surfaces 5*e*', 5*d*'.

By threading the bolt 4 into the nut 6 through the bolt hole 5*f* of the tightening tool 5' in this state, the tightening tool 5' is lowered, and the clamping members 3*c*'-1 to 3*c*'-4 are pressed along the tapered surfaces in the horizontal direction and brought closer together. Thus, the free ends of the terminal fitting connected to the clamping members move in the closing direction, and the terminal 3' is clamped tightly against battery post 2.

Normally, as shown in FIG. 16A, the battery post 2 is secured to the top of the battery 1 with a flange 2*a*. Thus, when the terminal 3' of the battery terminal P2 is connected to the post 2, the lower terminal fitting contacts the top of the flange 2*a*, and a gap S results between the top of the battery 1 and the bottom clamping members 3*c*'-3 and 3*c*'-4, which are on approximately the same plane as the lower terminal fitting.

If the bottom surfaces of the bottom clamping members 3*c*'-3 and 3*c*'-4 are not supported and there is a gap S as described above, there will be insufficient strength to withstand the vertical force when tightening the bolt 4. Thus, when the tightening tool 5' is lowered by the bolt 4, bottom clamping members 3*c*'-3 and 3*c*'-4 do not move horizontally due to the tapered surfaces 5*b*' and 5*d*' of the tightening tool 5', and the tightening tool 5' can therefore move easily down in the direction of arrow X2.

It is to be noted that the top clamping members 3*c*'-1 and 3*c*'-2 do not descend and move horizontally closer due to tapered surfaces 7*a*' and 7*c*' because the bottom surfaces thereof are positioned at the top surface of the nut 6.

If the bottom clamping members do not move horizontally closer together as described above, the bottom free ends of the connected terminal fitting are not clamped, and the terminal 3' is not sufficiently pressed against the post 2.

SUMMARY OF THE INVENTION

The object of the present invention is therefore to provide a connector which solves these problems.

The present invention has been developed with a view to substantially solving the above described disadvantages and has for its essential object to provide an improved battery terminal.

In order to achieve the aforementioned objective, a battery terminal for a terminal post of a battery comprises holding means formed by a single plate for holding said terminal post comprising a first holding member for holding said terminal post and provided with a first pair of tapered outer surfaces; and a second holding member for holding said terminal post and provided with a second pair of tapered outer surfaces; and pressure means having a first pair of tapered inner surfaces engageable to said first pair of tapered outer surfaces and a second pair of tapered inner surfaces engageable to said second pair of tapered outer surfaces, whereby when said pressure means is forced to move toward said holding means, said first and second pairs of tapered inner surfaces press said first and second pairs of tapered outer surfaces, respectively, to compress said holding means to hold said terminal post.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

First Embodiment

Figure 1:
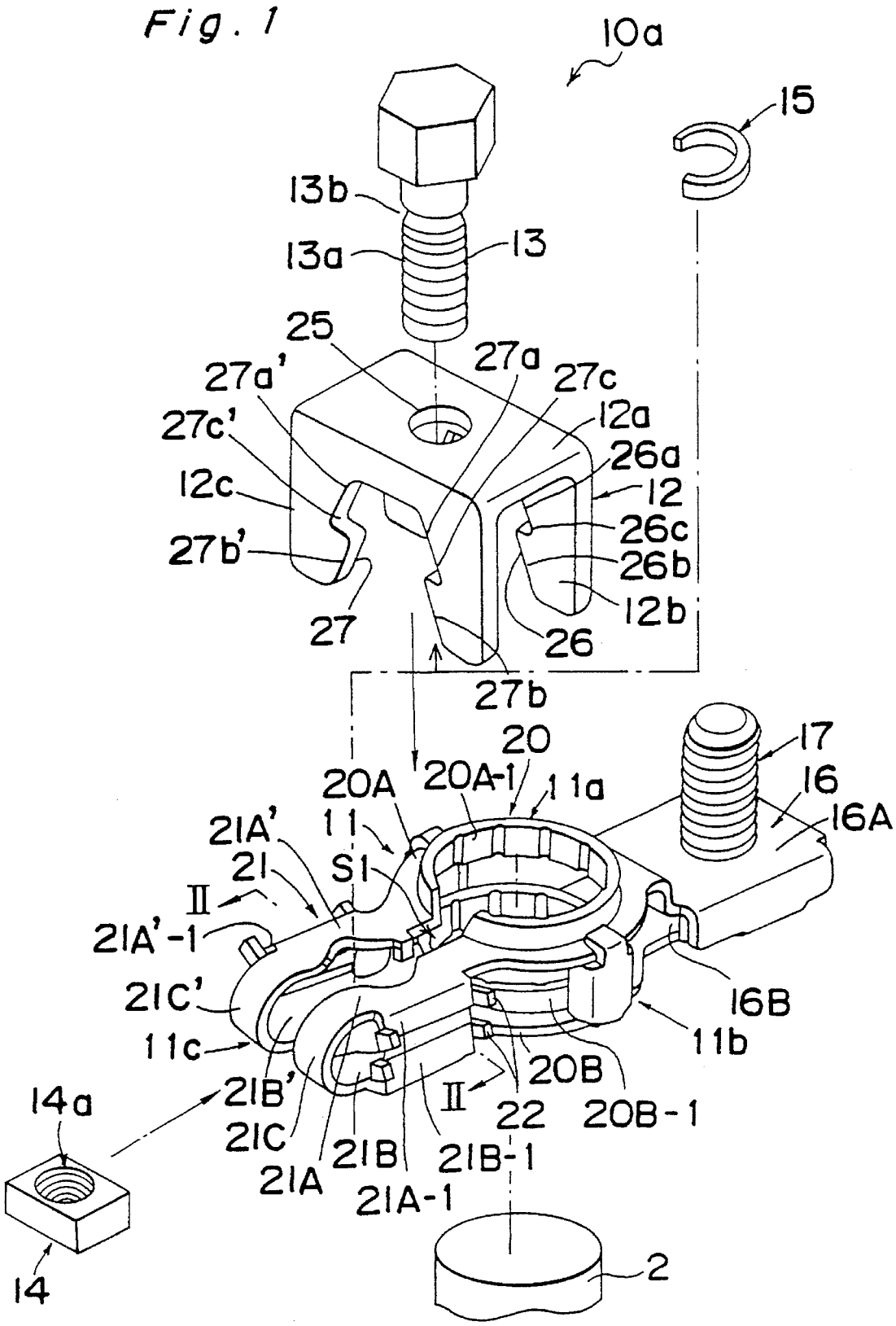
FIG. 1 is a perspective exploded view showing a battery terminal according to a first embodiment of the present invention.

Referring to FIGS. 1, 2, 3A and 3B, a battery terminal according to a first embodiment of the present invention is shown. The battery terminal 10*a* comprises a terminal 11, tightening tool 12, bolt 13, nut 14, and ring 15.

As best shown in FIG. 1, the terminal 11 is a stud-type terminal formed by bending a single metal plate in two. The terminal 11 has a stud bolt 17 extending through a cable connector 16 at one end, and a terminal (not shown) crimp-connected to an electrical cable is tightened by a nut (not shown) so as to connect to the stud bolt 17.

In the terminal 11, a top part 11a and a bottom part 11*b*, both of which are substantially identical to in shape are integrally connected by a curved part 11*c* at one end such that top and bottom parts 11*a* and 11*b* are located to vertically opposed positions, thus forming the cable connector 16, terminal fitting member 20, and tightening members 21.

More specifically, the connector 16 has top and bottom connectors 16A and 16B which are formed in roughly rectangular shapes, and each of connectors 16A and 16B is continuous to top and bottom fitting members 20A and 20B formed in ring-shapes, respectively. The top and bottom fitting members 20A and 20B form the terminal fitting member 20. A top cylindrical sleeve 20A-1 is placed along the inside circumference of the top fitting member 20A. Similarly, a bottom cylindrical sleeve 20B-1 is placed along the inside circumference of the bottom fitting member 20B.

The ends of the terminal fitting members 20A and 20B are open. Top tightening members 21A and 21A' are provided continuous to the free end of the top fitting member 20A, and bottom tightening members 21B and 21B' are provided continuous to the free end of the bottom fitting member 20B. The ends of right-side tightening members 21A and 21B located on the right side and left-side tightening members 21A' and 21B' located on the left side are linked by a right curved part 21C and a left curved part 21C', respectively.

A right top sliding member 21A-1 sloping downward to the outside projects at the outside edge of the right top tightening member 21A, and a left top sliding member 21A'-1 projects at the outside edge of the left top tightening member 21A'. A right bottom sliding member 21B-1 sloping upward to the inside projects at the outside edge of the right bottom tightening member 21B. Similarly, a left bottom sliding member 21B'-1 (FIG. 2) sloping upward to the inside projects at the outside edge of the left bottom tightening members 21B'.

Figure 2:
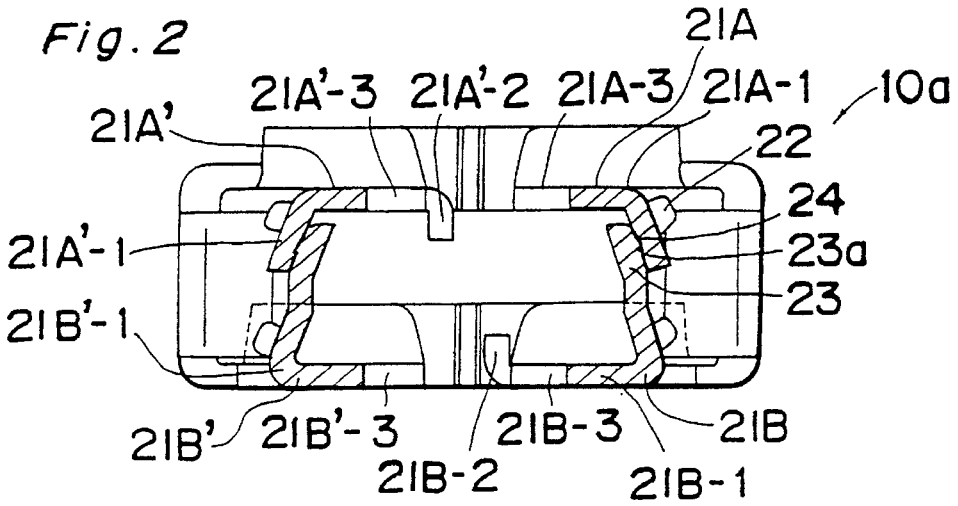
FIG. 2 is a cross-sectional view taken along a line II—II shown in FIG. 1, FIGS. 3A and 3B are cross sectional views in assistance of enplaning the operation of the battery terminal of FIG. 1.

As best shown in FIG. 2, the top part of each bottom sliding members 21B-1 and 21B'-1 is bent to the outside to provide engaging surfaces 23 contacting the inside surface of the top sliding members 21A-1 and 21A'-1. A projection 23*a* is provided on each engaging surface 23. A depression 24 corresponding to the projection 23*a* on the engaging surface 23 is formed on the inside surface of each of the top sliding members 21A-1 and 21A'-1 so that these projections 23*a* and depressions 24 interlock.

Referring back to FIG. 1, guide members 22 projecting to the outside are provided at both sides of the right top sliding member 21A-1, adjacent the right top fitting member 20A and the right curved part 21C, respectively. These guide members 22 can contact both sides of the tightening tool 12 to enable free movement thereof when the tightening tool 12 is mounted thereover. The tightening tool 12 is thus held to enable movement in the vertical direction between these guide members 22. Similarly, each of right bottom tightening member 21B-1, and left tightening members 21A'-1 and 21B'-1 are provided with guide members 22 at both ends thereof.

As shown in FIG. 2, in addition, engaging members 21A-2 (not shown), 21A'-2, 21B-2, and 21B'-2 (not shown) for positioning the nut 14 are provided projecting at specified positions on the inside edges of the sliding members 21A, 21A', 21B, and 21B', respectively.

Curved cut-outs 21A-3 and 21A'-3 for passing the bolt 13 are provided at approximately the middle of the inside edges of the top tightening members 21A and 21A', respectively. Similarly curved cut-outs 21B-3, and 21B'-3 are also provided at approximately the middle of the inside edges of the bottom tightening members 21B and 21B'. A space S1 (FIG. 1) is also provided between right and left tightening members 21A and 21A' and 21B and 21B'.

As best shown in FIG. 1, the tightening tool 12 is a generally inverted U-shaped member comprising a top member 12*a*, a front side member 12*c* and a back side member 12*b*. The front and back side member 12*c* and 12*b* extend perpendicularly from both sides of the top member 12*a*. A bolt hole 25 is opened in the center of the top member 12*a*. Cut-outs 26 and 27 open to the bottom are provided at the center in both side members 12*b* and 12*c*.

Figure 3A:
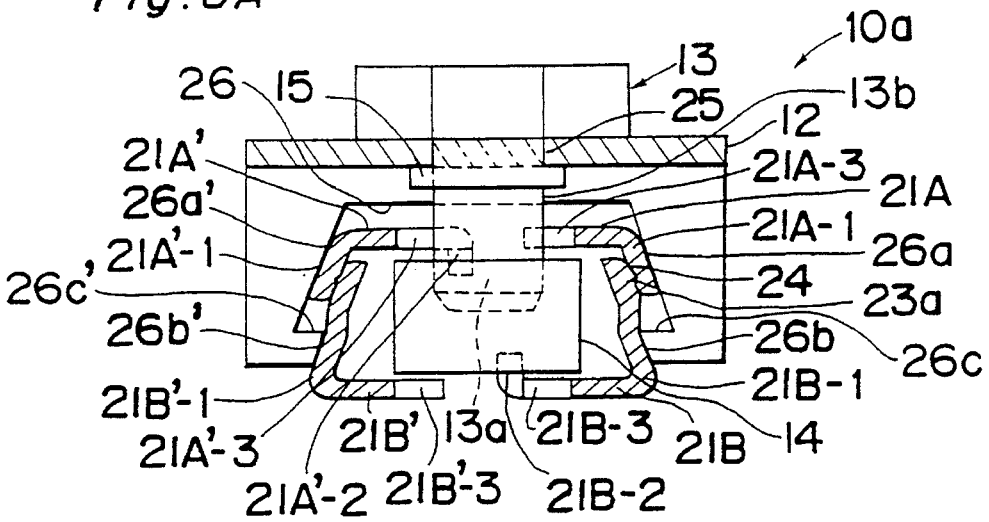

The back side member 12*b* is provided with tapered surfaces 26*a* and 26*b* are formed in two vertical stages and spreading open to the bottom at the right side thereof, and a shoulder part 26*c* is formed between the tapered surfaces 26*a* and 26*b*. As best shown in FIG. 3A, also at the left side of the cut-out 26, tapered surfaces 26*a*' and 26*b*' and shoulder part 26*c*' are formed. Each of shoulder parts 26*c* and 26*c*' horizontally extend toward each other, so that the cut-out 26 is formed to have a neck portion narrowed by the shoulder parts 26*c* and 26*c*'. Similarly, the front side member 12*c* is also provided with tapered surfaces 27*a* and 27*b* and shoulder part 27*c* at the right side of the cut-out 27, and tapered surfaces 27*a*' and 27*b*' and shoulder part 27*c* at the left side of the cut-out 27.

The bolt 13 passes through the bolt hole 25 formed in the tightening tool 12 such that a shank 13*a* of the bolt 13 is threaded into the nut 14. At this time, The ring 15 is fit to a ring channel 13*b* provided above the shank 13*a*, as shown in FIG. 3A, after the ring channel 13*b* passes through the bolt hole 25 so that when the bolt 13 is loosened and rises, the tightening tool 12 also rises.

Figure 3B:
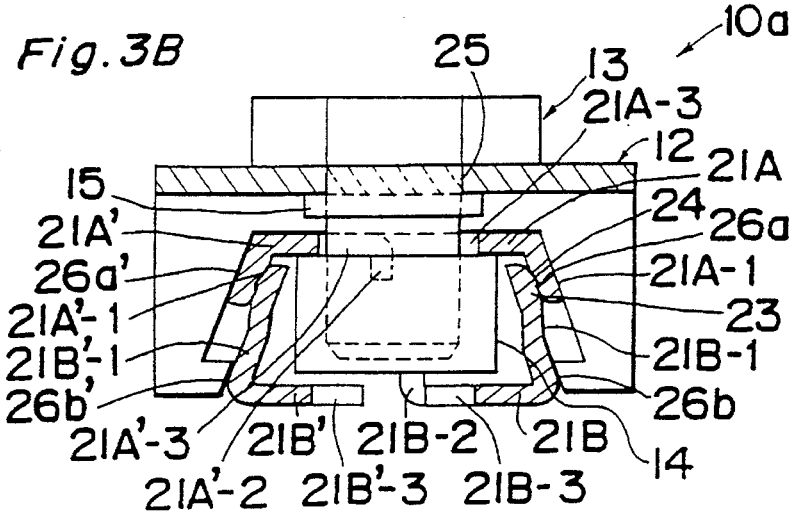

Referring to FIGS. 3A and 3B, the nut 14 placed inside the terminal 11 is shown. The nut 14 is provided between the top tightening members 21A and 21A' and the bottom tightening members 21B and 21B' so that the nut 14 is positioned by the engaging members 21A-2 to 21B'-2 projecting from the tightening members 21A to 21B'. In addition, threaded hole 14*a* formed in the nut 14 is aligned with cutouts 21A-3 to 21B'-3 formed in the tightening members 21A to 21B'.

Hereinbelow, the process of assembling the battery terminal 10*a* to the battery post 2 is described. First, the battery terminal 10*a* is placed over the top tightening members 21A and 21A', and then moved down to the sliding members 21A-1 to 21B'-1 as guided by the guide members 22 so that the tapered surfaces 26*a* to 27*b*' contact the outside surfaces of sliding members 21A-1 to 21B'-1 as shown in FIG. 3A. Then, the bolt 13 is passed through the bolt hole 25 of tightening tool 12 from the shank 13*a*, and is threaded into the nut 14 placed inside the tightening members 21A to 21B' in a partially engaged position.

In this partially engaged position, the side members 12*b* and 12*c* of the tightening tool 12 move freely against the top and bottom sliding members 21A-1 to 21B'-1 provided on the outside ends of the tightening members 21A to 21B' The shoulder parts 26*c* and 27*c* project into the space between the right sliding members 21A-1 and 21B-1, and the shoulder parts 26*c*' and 27*c*' project into the space between the left sliding members and 21A'-1 and 21B'-1, i.e., to both sides of the nut 14.

Also in this partially engaged position, the bolt 13 is connected to the nut 14, and the top tightening members 21A and 21A' are supported by the nut 14. It is to be noted that only the cut-out 26 side shown in FIGS. 3A and 3B is described below because the other cut-out 27 side is the same.

In this partially engaged position, there is a space S1 on both sides between top tightening members 21A and 21A' and between bottom tightening members 21B and 21B'. The free end sides of the terminal fitting members 20A and 20B continuous to the top tightening members 21A and 21A' and the bottom tightening members 21B and 21B', respectively, are wide and open.

The pair of top and bottom fitting members 20A and 20B are fit to the battery post 2 from above in this state. This fitting operation can be easily completed because the free ends of the fitting members 20A and 20B are wide open.

Next, the bolt 13 is tightened down from vertically above using an impact wrench or other tightening means. With this tightening operation, the tightening tool 12 moves down and the tapered surfaces 26*a* to 26*b*' of the cut-out 26 press the top and bottom sliding members 21A-1 to 21B'-1 of the right and left tightening members 21A to 21B' horizontally to the inside.

The bottom sliding members 21B-1 and 21B'-1 of the terminal 11 are connected to the top sliding members 21A-1 and 21A'-1 by the engagement of projections 23*a* and depressions 24. In addition, as the tightening tool 12 descends, the top tightening members 21A and 21A' supported by the nut 14 move relatively up. Thus, the bottom tightening members 21B and 21B' are not pushed down and deformed even when pressed from above by the bottom tapered surfaces 26*b* and 26*b*' of the tightening tool 12 during bolt tightening.

As thus described, the vertically-applied tightening force of the bolt 13 is converted to the horizontal direction by the tapered surfaces 26*a* to 26*b*', the top tightening members 21A and 21A' and the bottom tightening members 21B and 21B' on both right and left sides move mutually closer. And the free ends of the continuous terminal fitting members 20A and 20B are tightened in the closing direction. Thus, the terminal fitting members 20A and 20B are pressed against the outside circumference of the post 2, and the battery terminal 10*a* is tightly clamped to the battery post 2.

Second Embodiment

Figure 4:
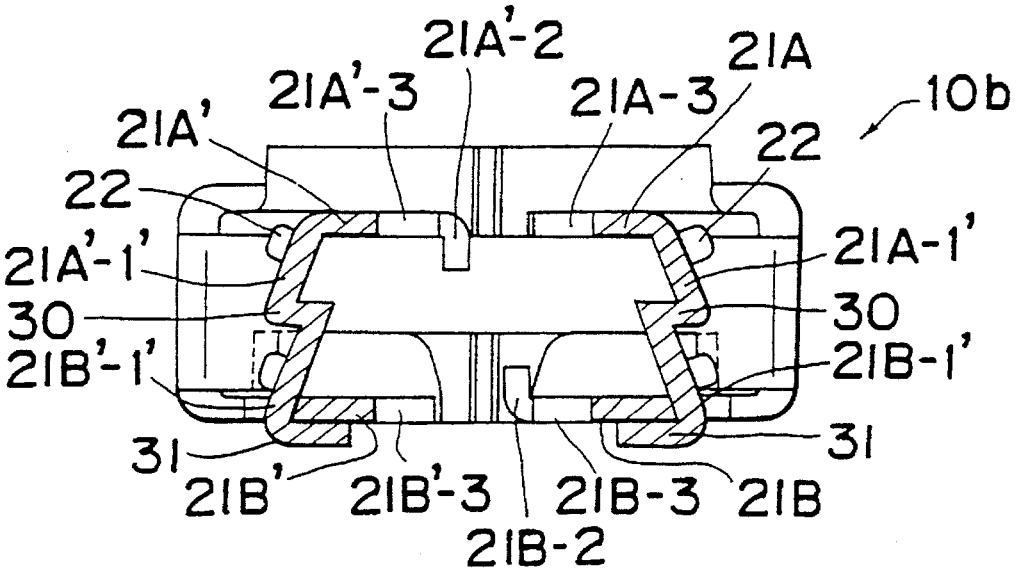
FIG. 4 is a view similar to FIG. 2, but showing a battery terminal according to a second embodiment of the present invention.

Referring to FIG. 4, a battery terminal 10*b* according to a second embodiment of the present invention is shown. In this battery terminal 10*b*, individual sliding members are formed extending from the outside edge of the top tightening members 21A and 21A' to the bottom surface of the bottom tightening members 21B and 21B'. These sliding members are shaped according to the shape of the cut-outs 26 and 27 formed in tightening tool 12 such that a top sliding member 21A-1' and a bottom sliding member 21B-1' formed in the right tightening members 21A and 21B are connected by a connecting member 30. Similarly, sliding members 21A'-1' and 21B'-1' connected by connecting member 30 are formed in left tightening members 21A' and 21B'

In other words, both sides of the top tightening members 21A and 21A' are bent to form the top sliding members 21A-1' and 21A'-1' spreading down to the outside corresponding to the tapered surfaces 26*a*, 26*a*', 27*a*, and 27*a*' of the tightening tool 12.

The top sliding members 21A-1' and 21A'-1' are further bent horizontally to the inside to form the connecting members 30 corresponding to the shoulder parts 26*c*, 26*c*', 27*c*, and 27*c*' of the tightening tool 12 approximately centered between the top tightening members 21A and 21A' and bottom tightening members 21B and 21B'.

The bottom sliding members 21B-1' and 21B'-1' are further provided by bending the ends of the connecting members 30 spreading down to the outside corresponding to the tapered surfaces 26*b*, 26*b*', 27*b*, and 27*b*' of the tightening tool 12. The inside surfaces of the bottom sliding members 21B-1' and 21B'-1' contact the outside ends of the bottom tightening members 21B and 21B'. Furthermore, the bottom ends of the bottom sliding members 21B-1' and 21B'-1' are bent horizontally to the inside to form engaging members 31 engaging the bottom surface of the bottom tightening members 21B and 21B'.

In this battery terminal 10*b*, as in those of the first embodiment, the bottom tightening members 21B and 21B' will not descend because sliding members 21A-1' to 21B'-1' are provided extending from the outside edge of the top tightening members 21A and 21A' to the bottom tightening members 21B and 21B'. And the engaging members 31 at the bottom end thereof are positioned to engage and hold the bottom surface of the bottom tightening members 21B and 21B'.

Third Embodiment

Figure 5:
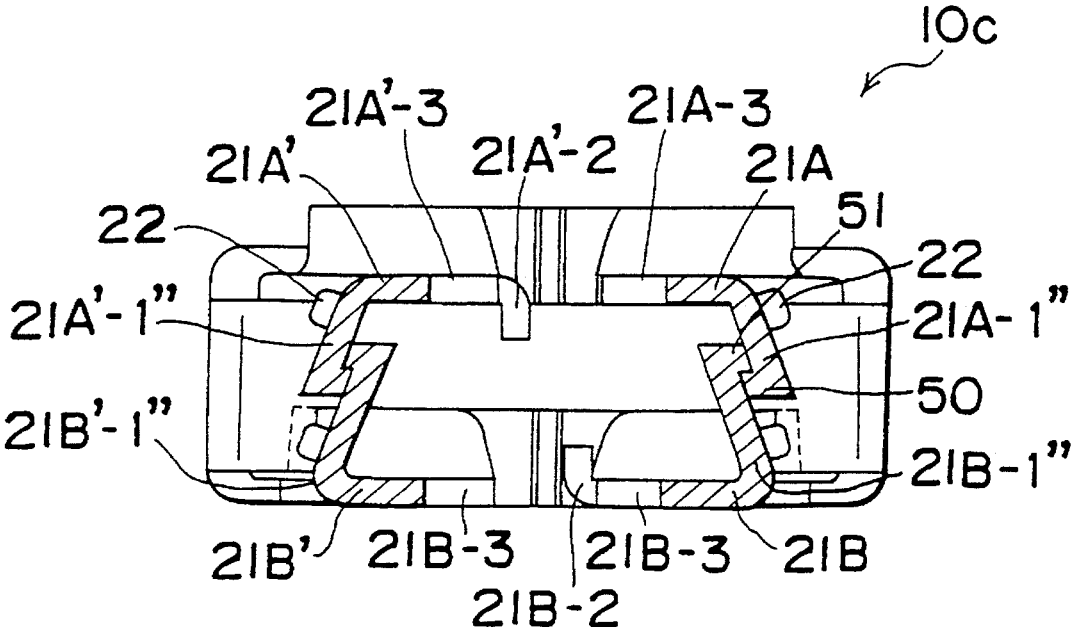
FIG. 5 is a view similar to FIG. 4, but showing a battery terminal according to a third embodiment of the present invention.

Referring to FIG. 5, a battery terminal 10*c* according to a third embodiment of the present invention is shown. In the battery terminal 10*c*, as in the first embodiment, top sliding members 21A-1" and 21A'-1" are provided by bending the outside edge of the top tightening members 21A and 21A' spreading down to the outside, and bottom sliding members 21B-1" and 21B'-1" are formed by bending the bottom tightening members 21B and 21B' upward to the inside corresponding to the tapered surfaces 26*a* to 27*b*' of the tightening tool 12.

In addition, the bottom ends of the top sliding members 21A-1" and 21A'-1" are bent to the inside to form engaging members 50. The top ends of the top sliding members 21B-1" and 21B'-1" are bent to the outside to form engaging members 51. These engaging members 50 and 51 projecting in an L-shape are placed in contact to interlock.

In this battery terminal 10*c*, as in those of the first embodiment and the second embodiment, even if the tightening tool 12 is driven down by tightening the bolt 13, the bottom tightening members 21B and 21B' do not descend due to engagement of the engaging members 50 and 51, the vertical tightening force is positively converted to a horizontal tightening force, and the battery post 2 is securely clamped.

It is to be noted the battery terminal of the present embodiments shall not be limited to the above configurations, and any configuration whereby the top and bottom tightening members interlock and the bottom tightening member is supported by the top tightening member can be used.

As will be known from the above descriptions on the first, second, and third embodiments, the bottom tightening member is supported by the top tightening member supported by the nut in a battery terminal according to the present invention because the top and bottom tightening members of the tightening tool engage.

Thus, the bottom tightening member will not descend and deform even if the tightening tool descends due to tightening the bolt. Accompanying this, the vertically-applied tightening force is converted to a horizontal tightening force by the tapered surfaces of the tightening tool, the free ends of the terminal fitting members continuing from the top and bottom tightening members move in the closing direction, and the battery post can be positively clamped.

Fourth Embodiment

Figure 6:
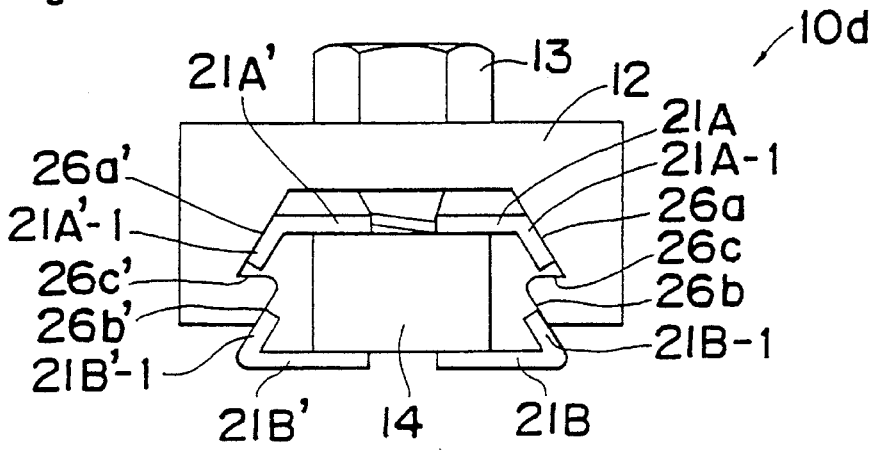
FIG. 6 is a front view showing a battery terminal according to a fourth embodiment of the present invention in a semi-assembled state.
Figure 7:
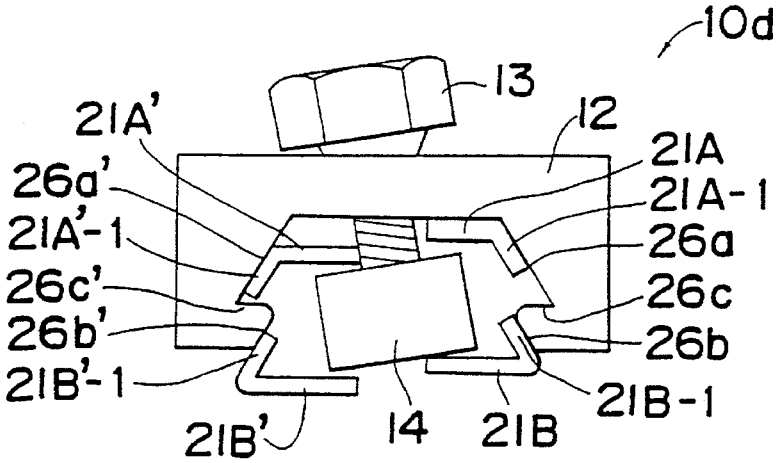
FIG. 7 is a front view showing the battery terminal of FIG. 6 in a troubled state.
Figure 8:
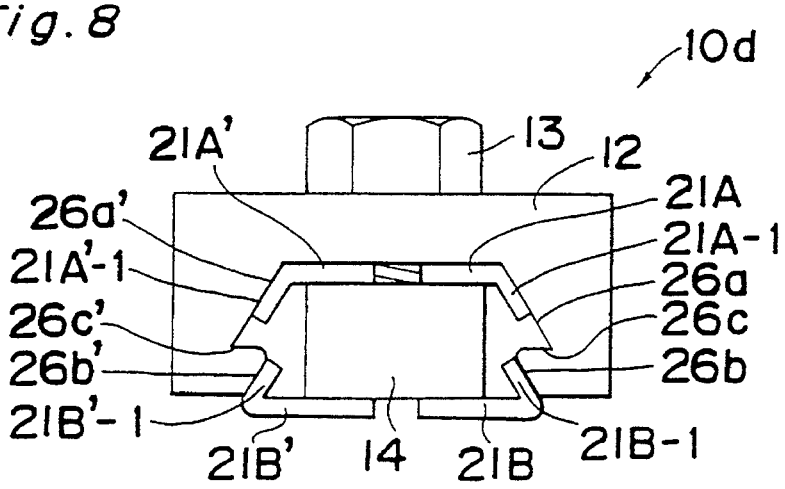
FIG. 8 is a front view showing the battery terminal of FIG. 6 in a clamped condition.

Referring to FIGS. 6, 7 and 8, a battery terminal 10*d* according to a fourth embodiment is shown. In the battery terminal 10*d*, the nut 14 is slightly thicker than the space between substantially V-shaped top tightening members 21A and 21A' and substantially V-shaped bottom tightening members 21B and 21B'. The nut 14 is positioned between the top tightening members 21A and 21 and bottom tightening members 21A' and 21B' such that the top tightening members 21A and 21A' are tight to and able to slide against the top surface of the nut 14, and the bottom tightening members 21B and 21B' are tight to and able to slide against the bottom surface of the nut 14. The threaded hole 14*a* formed in the nut 14 is aligned with cut-outs 21A-3 to 21B'-3.

Hereinbelow, the process of assembling the battery terminal 10*d* to the battery post 2 is described. Before the battery terminal 10*d* is installed to the battery post 2, the tightening tool 12 is placed between the guide members 22 of the terminal 11, and the bolt 13 is passed through the tightening tool 12 to the nut 14 positioned between the tightening members 21A to 21B' to the semi-assembled position, as best shown in FIG. 6.

In this semi-assembled position, the outside surfaces of both side members 12*b* and 12*c* of the tightening tool 12 slide freely against the guide members 22, the tapered surfaces 26*a* to 27*b*' slide freely against the corresponding sliding members 21A-1 to 21B'-1 of the terminal 11. And the shoulder parts 26*c* to 27*c*' of the tapered surfaces 26 and 27 contact the bottom edge of the top sliding members 21A-1 and 21A'-1. In addition, the top and bottom tightening members 21A to 21B' are tight to slide freely against the top and bottom surfaces of the nut 14. It is to be noted that because the cut-outs 26 and 27 are identical, a detailed description of the cut-out 27 side is omitted below.

With the tightening tool 12 semi-assembled to the terminal 11 as described above, the terminal fitting member 20 is fit onto the battery post 2 from above. At this time, there is a space S1 on both sides between top tightening members 21A and 21A' and between bottom tightening members 21B and 21B', and the free end side of the top and bottom fitting members 20A and 20B continuous to the tightening members 21A to 21B' is wide and open. Thus, fitting the battery terminal 10*d* in the above semi-assembled position to the battery post 2 can be easily accomplished.

Next, the bolt 13 is tightened down from vertically above. With this tightening operation, the tightening tool 12 moves down and the tapered surfaces 26*a* to 26*b*' of the tightening tool 12 press the sliding members 21A-1 to 21B'-1 of the terminal 11 to the inside, and tightening members 21A to 21B' continuous to the sliding members 21A-1 to 21B'-1 move in the direction closer together while sliding over the top and bottom surfaces of the nut 14.

During the above operation, the tightening tool 12 is restricted by guide members 22 and moves positively down. Thus, with descent of the tapered surfaces of the tightening tool 12, the sliding members 21A-1 to 21B'-1 can be positively moved horizontally.

In addition, because the top and bottom surfaces of the nut 14 are in contact with the tightening members 21A to 21B', tilting of the nut 14*f*, as shown in FIG. 7, can be prevented. It is to be noted that if the nut 14 tilts, uneven pressure acts on the right and left tightening members 21A and 21A' (21B and 21B'). In this case, variations occur in the tightening force, i.e., the amount of movement, of the right and left tightening members 21A to 21B'. However, because the top and bottom tightening members 21A to 21B' are tight to the nut 14 to prevent tilting of the nut 14 as described above, the right and left tightening members 21A to 21B' can be moved evenly.

As thus described, the vertically-applied tightening force of the bolt 13 is converted to a force in the horizontal direction by the tapered surfaces 26*a* to 27*b*' of the tightening tool 12. The right and tightening members 21A and 21A' (21B and 21B') move closer together, as shown in FIG. 8, so that the free ends of the continuous terminal fitting members 20A and 20B are tightened in the closing direction. Thus, the terminal fitting members 20A and 20B are pressed against the outside circumference of the post 2, and the battery terminal 10*d* is tightly clamped to the battery post 2.

Fifth Embodiment

Figure 9:
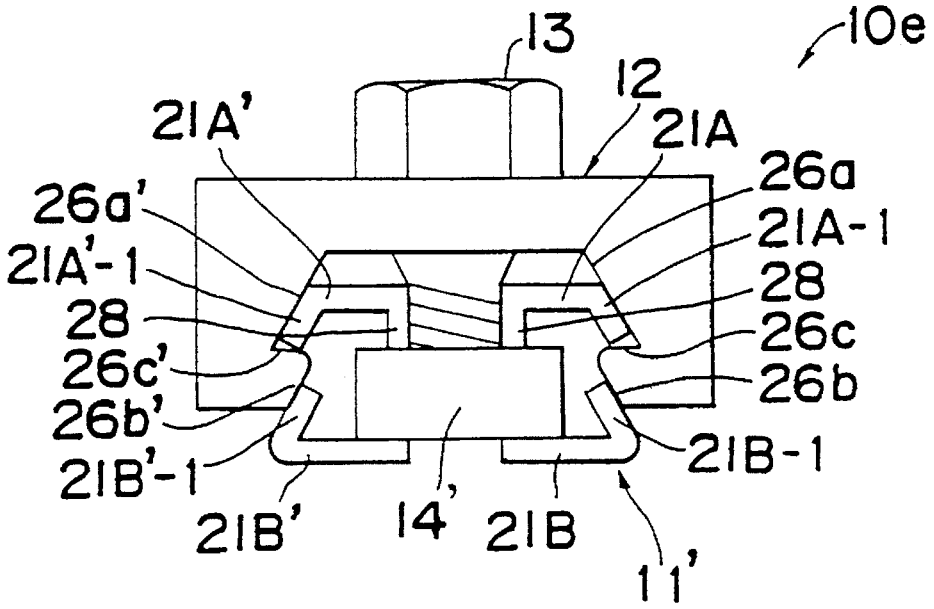
FIG. 9 is a front view showing a battery terminal according to a fifth embodiment of the present invention.

Referring to FIG. 9, a battery terminal 10*e* according to a fifth embodiment of the present invention is shown. The thickness of the nut 14 according to the fourth embodiment is made slightly greater than the space between the top and bottom tightening members 21A to 21B' of the terminal 11, and the top and bottom tightening members 21A to 21B' are tight against the top and bottom surfaces of the nut 14. However, in this battery terminal 10*e*, ribs 28 projecting downward are provided on the bottom surface of the top tightening members 21A and 21A' of a terminal 11'. This rib 28 pushes a nut 14' down, and holds the nut 14' between the rib 28 and bottom tightening members 21B and 21B' with no play.

It is to be noted that because the configuration and operation other than described above are identical to those of the fourth embodiment, description is omitted.

Sixth Embodiment

Figure 10:
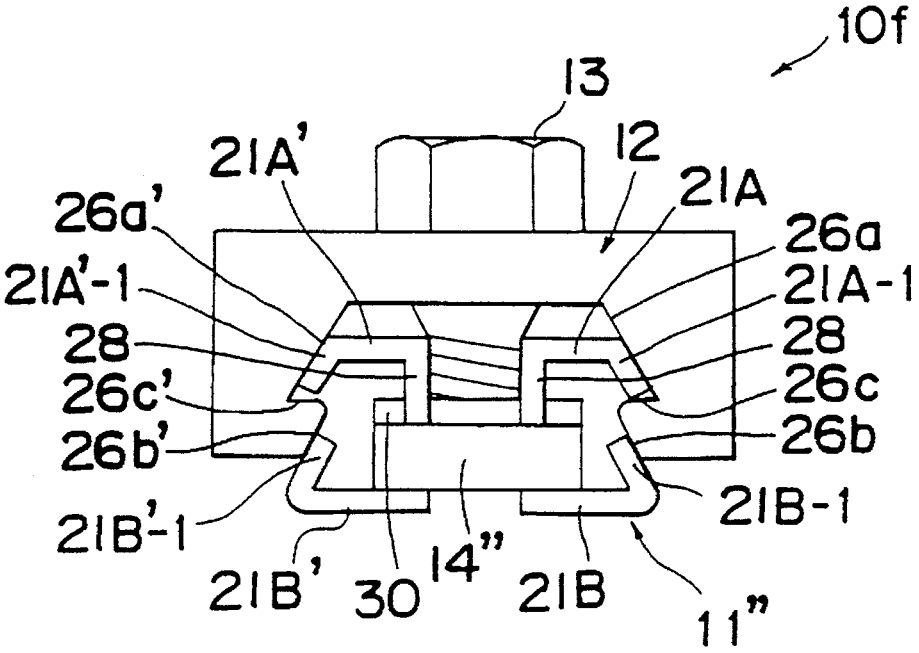
FIG. 10 is a front view showing a battery terminal according to sixth embodiment of the present invention.
Figure 11:
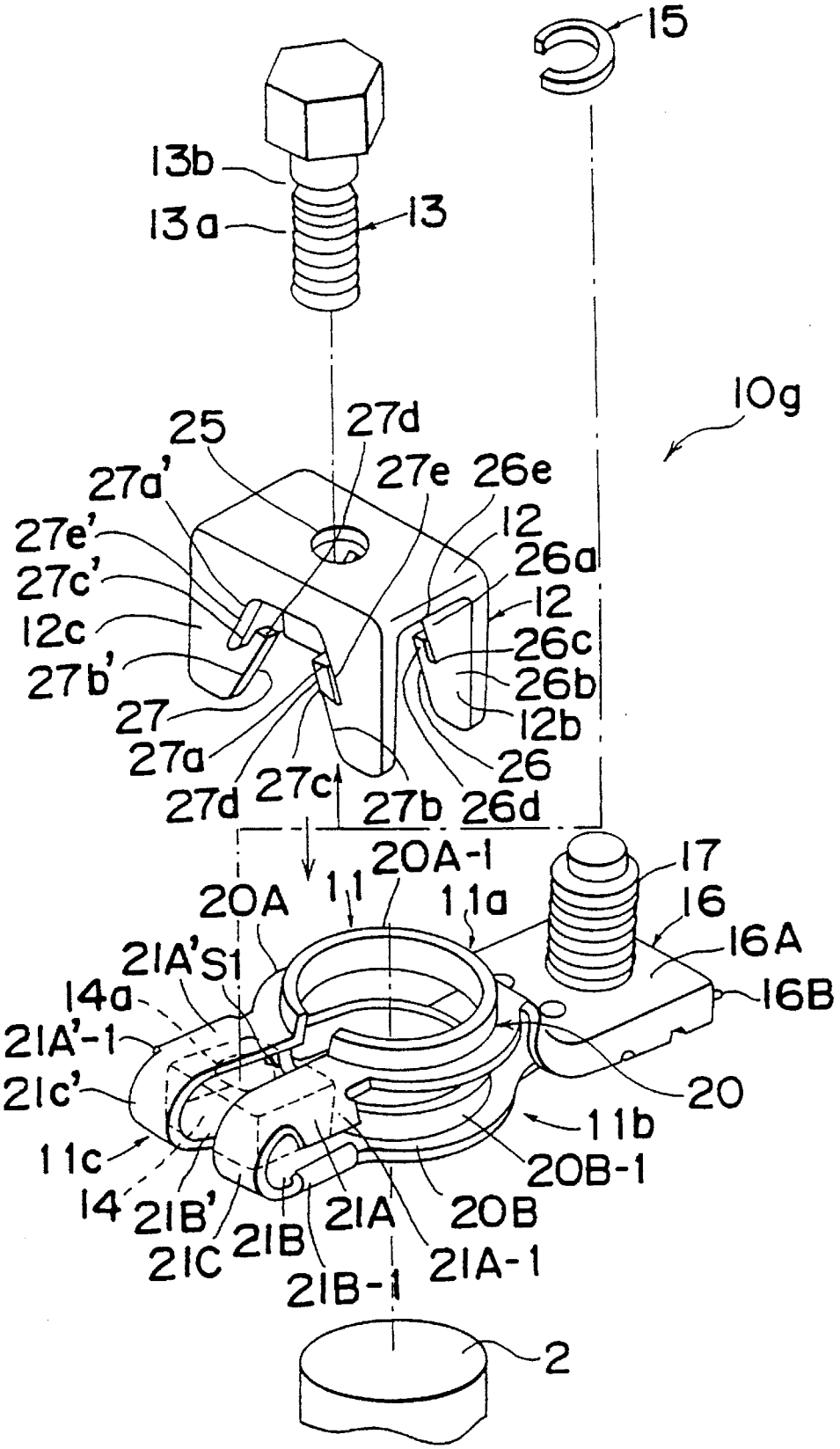
FIG. 11 is a perspective exploded view showing a battery terminal according to a seventh embodiment of the present invention.

Referring to FIG. 10, a battery terminal 10*f* according to sixth embodiment of the present invention is shown. In the battery terminal 10*f*, long channels 30 fit to enable the ribs 28 to slide freely are provided in the top surface of a nut 14". By thus fitting the ribs 28 into the long channels 30, the nut 14" is prevented from turning.

As will be known from the above descriptions on the fourth, fifth and sixth embodiments, the tapered surfaces of the tightening tool move in contact with the sliding members, and the sliding members can be moved positively in the horizontal direction by the tapered surfaces in a battery terminal according to the present invention because sliding members are formed on the right and left tightening members of the terminal.

Moreover, because the sliding members of the tightening members are evenly pressed to the inside by positive vertical movement of the tightening tool because the tightening tool can be positively guided in the vertical direction by the guide members, the nut is held without play between the top and bottom tightening members of the terminal, and the bolt can be stably tightened, the terminal fitting member can be positively clamped to the battery post with a stable tightening force.

Seventh Embodiment

Referring to FIGS. 11, 12, 13, and 14, a battery terminal 10*g* according to a seventh embodiment of the present invention is shown. The battery terminal 10*g* has a release tab 26*d* projecting upward at a slope to the inside from the inside edges of the shoulder part 26*c* as though integrally extending therefrom. The release tab 26*d* has a space to the corresponding upper stage tapered surface 26*a*, and this space is set to enable the top sliding member 21A-1 to be inserted and slide freely. Thus, a slit 26*e* for guiding the sliding member 21A-1 is formed between the upper tapered surface 26*a* and the release tab 26*d*.

Similarly, release tabs 26*d*', 27*d*, and 27*d*' are provided on the shoulder parts 26*c*', 27*c*, and 27*c*', respectively. These release tabs 26*d* to 27*d*' are mutually opposing with the space to corresponding upper stage tapered surfaces 26*a* to 27*a*' to enable the top sliding members 21A-1 and 21A'-1 of the terminal 11 to be inserted and slide freely. Thus, slits 26*e*, 26*e*', 27*e*, 27*e*' for guiding the sliding members are formed between the upper tapered surfaces 26*a* to 27*a*' and the release tabs 26*d* to 27*d*'.

The nut 14 is provided between the top tightening members 21A and 21A' and the bottom tightening members 21B and 21B', and threaded hole 14*a* is positioned in the space S1 between the right side tightening members 21A and 21B and the left side tightening members 21A' and 21B'.

Figure 12:
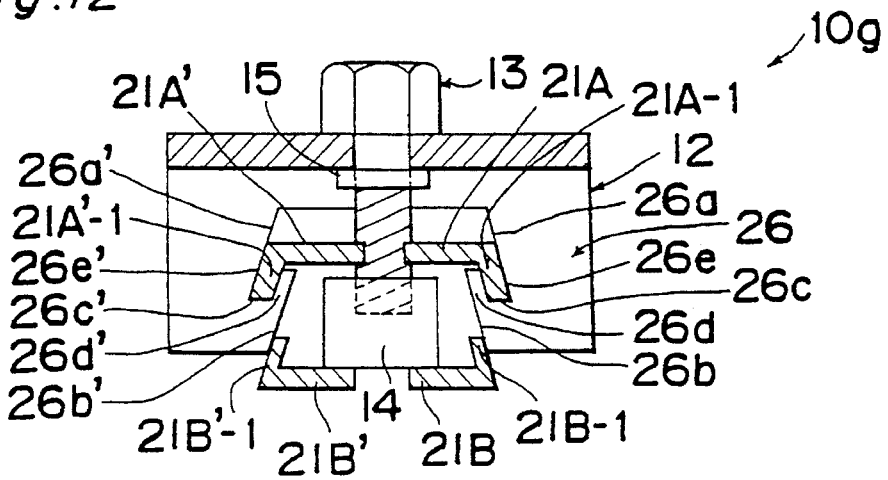
FIG. 12 is a cross-sectional view showing the battery terminal of FIG. 11 in a semi-assembled state.

Hereinbelow, the process of assembling the battery terminal 10*g* to the battery post 2 is described. Before the battery terminal 10*g* is installed to the battery post 2, the tightening tool 12 is fit to the tightening members 21A to 21B' of the terminal 11, and the bolt 13 is passed through the tightening tool 12 to the nut 14 positioned between the top tightening members 21A and 21A' and the bottom tightening members 21B and 21B' to the semi-assembled position, as best shown in FIG. 12.

In this semi-assembled position, the top sliding members 21A-1 to 21A'-1 of the terminal 11 are inserted to the slits 26*e*–27*e*' between the release tabs 26*d* to 27*d*' and the top tapered surfaces 26*a* to 27*a*' of the tightening tool 12.

In addition, the sliding members 21B-1 and 21B'-1 of the bottom tightening members 21A and 21B' contact the bottom tapered surfaces 26*b* to 27*b*' of the tightening tool 12.

It is to be noted that because the cut-outs 26 and 27 are the same, a detailed description of the cut-out 27 side is omitted below.

With the tightening tool 12 semi-assembled to the terminal 11 as described above, the terminal fitting member 20 is fit onto the battery post 2 from above. At this time, there is the space S1 between the top tightening members 21A and 21A' and between the bottom tightening members 21B and 21B' of the terminal 11, and the free end sides of the fitting members 20A and 20B continuous to the tightening members 21A to 21B' are wide and open. Thus, fitting the battery terminal 10*g* in the above semi-assembled position to the battery post 2 can be easily accomplished.

Next, the bolt 13 is tightened down from vertically above the battery terminal 10*g*. With this tightening operation, the tightening tool 12 moves down and the sliding members 21A-1 and 21A'-1 of the top tightening members 21A and 21A' in slits 26*e* and 26*e*' are pressed to the inside by the upper tapered surfaces 26*a* and 26*a*' of the tightening tool 12, and move in the direction closer together. In addition, the sliding members 21B-1 and 21B'-1 of the bottom tightening members 21B and 21B' are also pressed to the inside by the lower tapered surfaces **26*b* and 26*b*'**.

As thus described, the vertically-applied tightening force of the bolt 13 is converted to a force in the horizontal direction by the tapered surfaces **26*a* to 27*b*' of the tightening tool 12, the right and left tightening members 21A and 21B (21A' and 21B') move closer together, and the free ends of the continuous terminal fitting members 20A and 20B are tightened in the closing direction. Thus, the terminal fitting members 20A and 20B are clamped against the outside circumference of the post 2, and the battery terminal 10 is tightly clamped to the battery post 2**.

Figure 13:
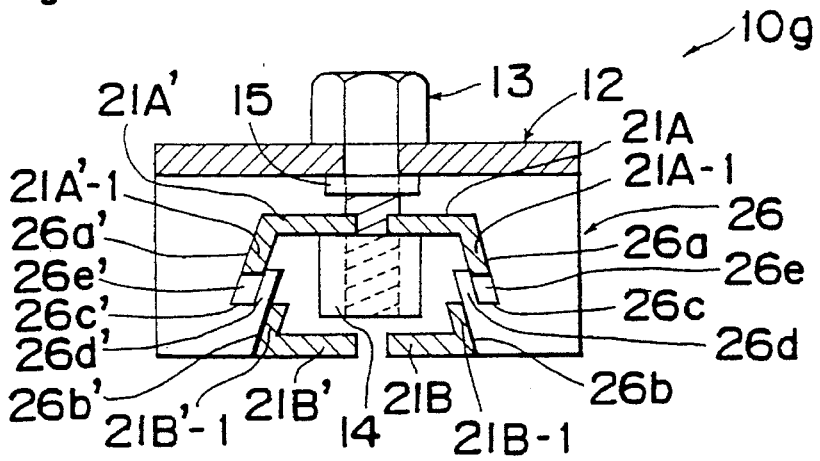
FIG. 13 is a view similar to FIG. 12, but showing the battery terminal of FIG. 11 in a clamped state.

In the state with the battery terminal **10*g* clamped to the battery post 2, the top sliding members 21A-1 and 21A'-1 are positioned at the top edge of the slits 26*e* and 26*e*'. The top end of the release tabs 26*d* and 26*d*' contact the bottom end of the top sliding members 21A-1 and 21A'-1, respectively, as shown in FIG. 13**.

On the other hand, when removing the battery terminal **10*g* which is in the clamped position (FIG. 13) from the battery post 2, the bolt 13 is loosened. When the bolt 13 is turned in the loosening direction, the tightening tool 12 is raised with the bolt 13 by the ring 15**.

Figure 14:
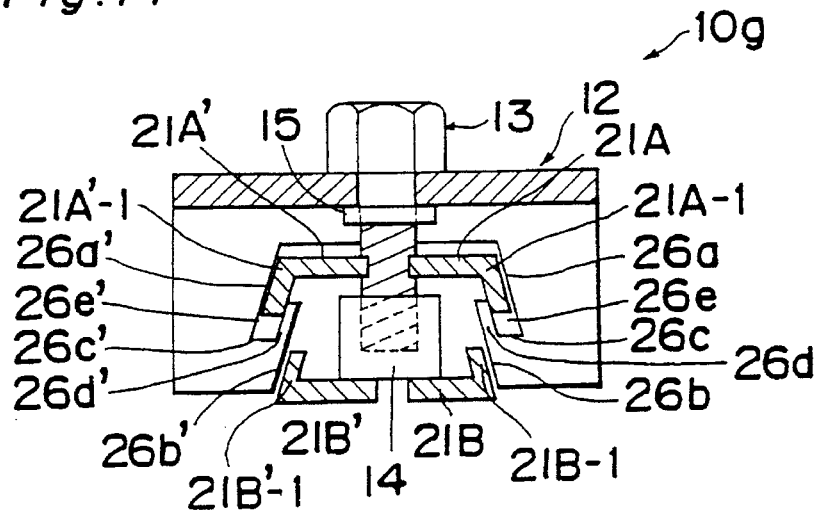
FIG. 14 is a view similar to FIG. 13, but showing the battery terminal in which the bolt and the tightening tool are in a lifted state.
Figure 15A:
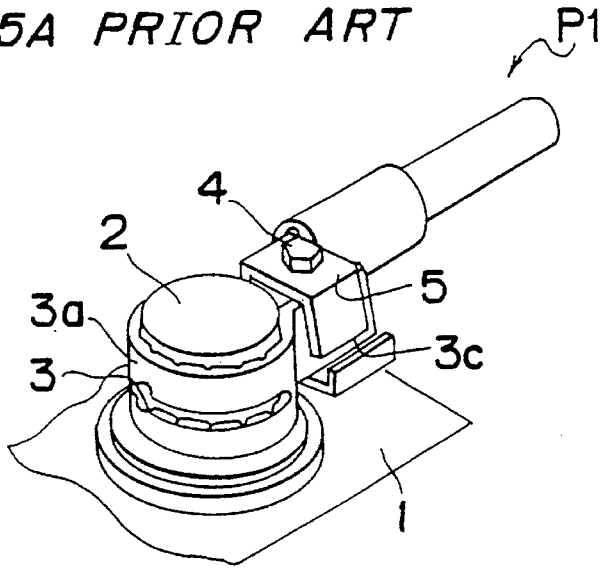
Fig. 15A PRIOR ART
FIG. 15A is a perspective view showing a conventional battery terminal assembled to the battery post.
Figure 15B:
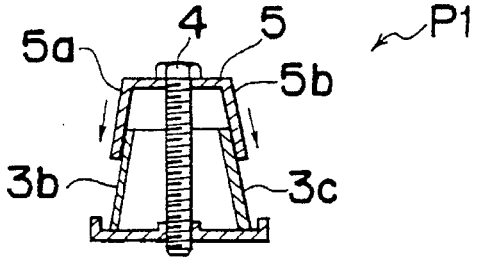
Fig. 15B PRIOR ART
FIG. 15B is a cross-sectional view showing the battery terminal of FIG. 15A before tightening the bolt.
Figure 15C:
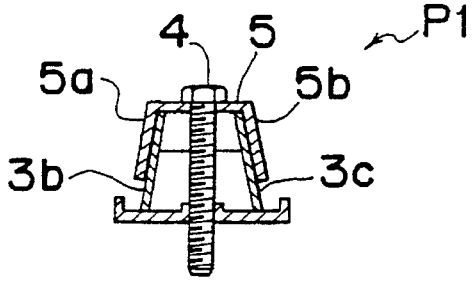
Fig. 15C PRIOR ART
FIG. 15C is a cross-sectional view showing the battery terminal of FIG. 15A after tightening the bolt.
Figure 15D:
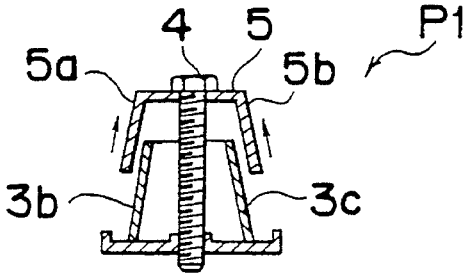
Fig. 15D PRIOR ART
FIG. 15D is a cross-sectional view showing the battery terminal of FIG. 15A of trouble.
Figure 16A:
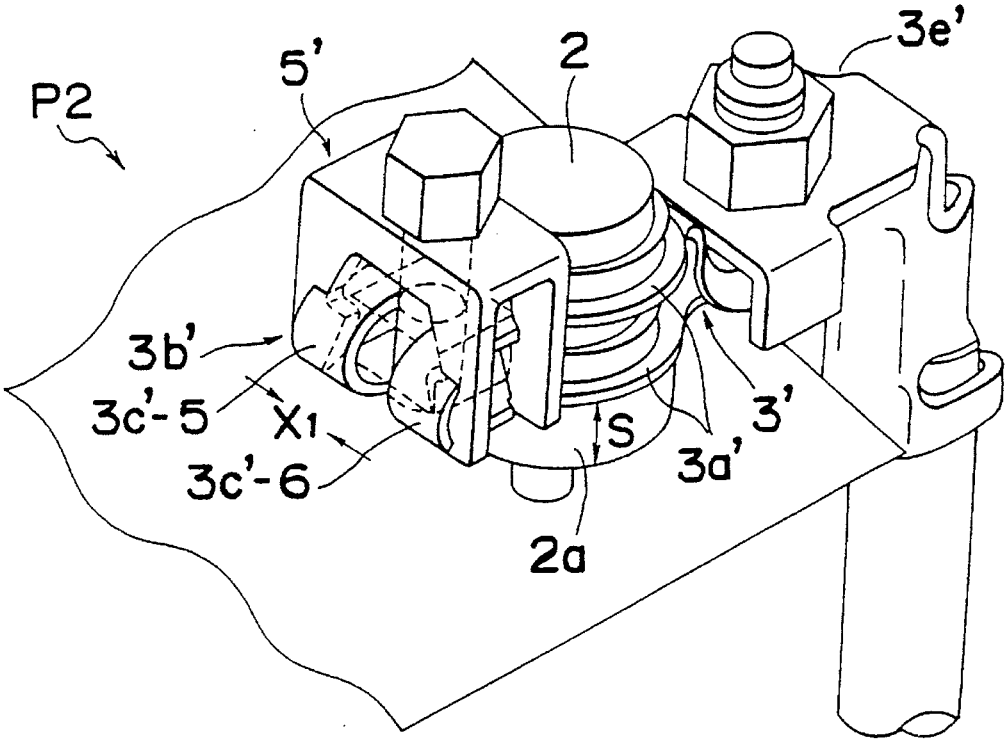
Fig.16A PRIOR ART
FIG. 16A is a perspective view showing another conventional battery terminal than that of FIG. 15A.
Figure 16B:
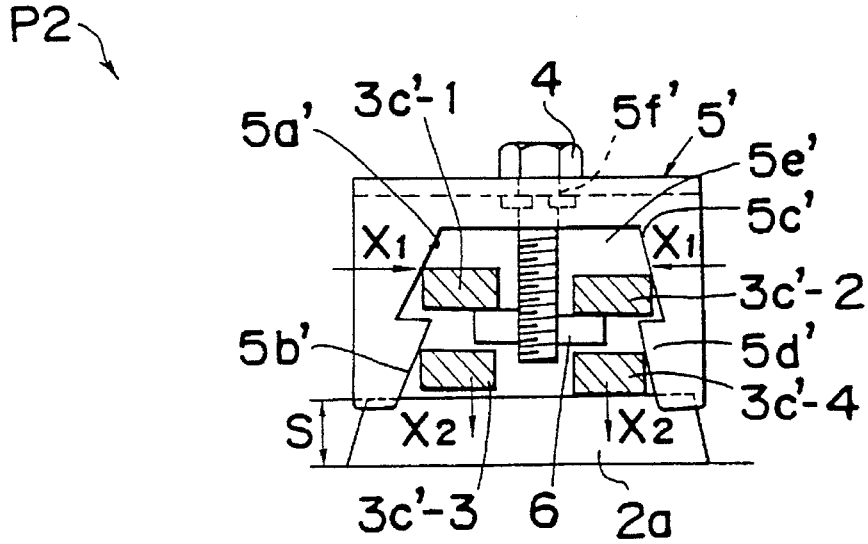
Fig. 16B PRIOR ART
FIG. 16B is a cross sectional view in assistance of explaining the operation of the battery terminal of FIG. 16A.

When the tightening tool 12 rises relative to the terminal 11, the release tabs **26*d* and 26*d*' of the tightening tool 12 rise while sliding along the inside surfaces of the top sliding members 21A-1 and 21A'-1 of the terminal 11, as shown in FIG. 14**.

Thus, the release tabs **26*d* and 26*d*' of the tightening tool 12 push and forcibly move to the outside the sliding members 21A-1 to 21B'-1. By the sliding members 21B-1 and 21B'-1 of the bottom tightening members 21B and 21B'** rising, the horizontal pressure in the approaching direction is also released, and move in the mutually separating direction.

Thus, the free ends of the terminal fitting members 20 connected by means of the right and left tightening members 21A and 21A' (21B and 21B') move in the mutually separating direction, and clamping to the battery post 2 is released.

As will be known from the above description, in the battery terminal according to the seventh embodiment, the free ends of the terminal fitting members continuous to the tightening members are opened and can be positively removed from the battery post because the tightening tool rises together with the bolt and the sliding members of the tightening members are forcibly pushed in the outside direction by the release tabs provided on the tightening tool when the bolt is loosened when removing a battery terminal according to the present invention from the battery post.

In addition, because sliding of the tightening members moves along the slits, positive tightening is also assured during tightening.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A battery terminal comprising:

a pair of right top and bottom tightening members and a pair of left top and bottom tightening members provided on each free end of a pair of top and bottom annular terminal fitting members of a terminal formed by folding a plate in two, each of said tightening members having sliding members, said top tightening members being separated from said bottom tightening members by a predetermined space;

a tightening tool having a cut-out formed by top and bottom two-stage tapered surfaces; said tapered surfaces being staggered and contacting the sliding members of each of said tightening members; and said pairs of right and left top and bottom tightening members being subtantially V-shaped, each including said sliding member sloping along and directly engaging respective said top and bottom two-stage tapered surfaces of said tightening tool, whereby when a bolt is tightened through a bolt hole formed in said tightening tool into a nut provided between said top and bottom tightening members, said nut being thicker than said predetermined space, whereby said pairs of right and left top and bottom tightening members are biased against respective top and bottom surfaces of said nut, said right and left top and bottom tightening members are moved towards each other horizontally by said sliding members moving along said tapered surfaces to close said each free end of said annular terminal fitting members.

2. A battery terminal as claimed in claim 1, wherein each of said sliding members are provided with guide members formed on ends thereof for holding both sides of said tightening tool to slide freely therebetween.

* * * * *